United States Patent [19]

Humphreys

[11] 4,220,104

[45] Sep. 2, 1980

[54] HOSIERY

[75] Inventor: John C. Humphreys, Hinckley, England

[73] Assignee: Paramount Textile Machinery Co., High Point, N.C.

[21] Appl. No.: 948,492

[22] Filed: Oct. 4, 1978

[51] Int. Cl.[2] ..... D05B 1/00; D05B 97/00

[52] U.S. Cl. ..... 112/262.1; 112/121.15

[58] Field of Search ..... 112/63, 121.15, 121.26, 112/262, 121.12, 407, 408, 409

[56] References Cited

U.S. PATENT DOCUMENTS

| | | | |
|---|---|---|---|
| 2,529,575 | 11/1950 | Sailer | 112/63 |
| 2,697,925 | 12/1954 | Goodman | 2/409 |
| 2,766,709 | 10/1956 | Stevens | 112/63 |
| 3,669,047 | 6/1972 | Hedegaard | 112/121.15 |
| 3,777,681 | 12/1973 | Horita | 112/262 X |
| 3,900,899 | 8/1975 | Bailey | 2/409 |
| 4,098,204 | 7/1978 | Kojima | 112/121.26 X |
| 4,100,624 | 7/1978 | Davis | 2/409 |

FOREIGN PATENT DOCUMENTS

| | | | |
|---|---|---|---|
| 24398 | 7/1972 | Australia | 112/121.15 |

*Primary Examiner*—Ronald Feldbaum

[57] ABSTRACT

The present invention relates to hosiery and particularly to the fixing of gussets on panti-hose or similar garments.

21 Claims, 7 Drawing Figures

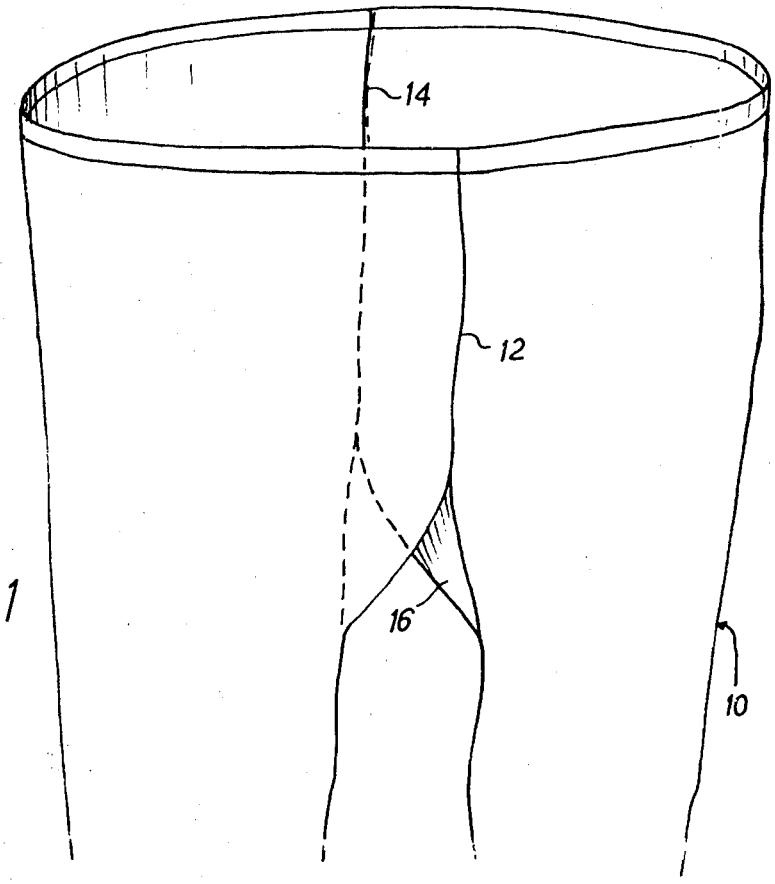
FIG. 1
FIG. 2
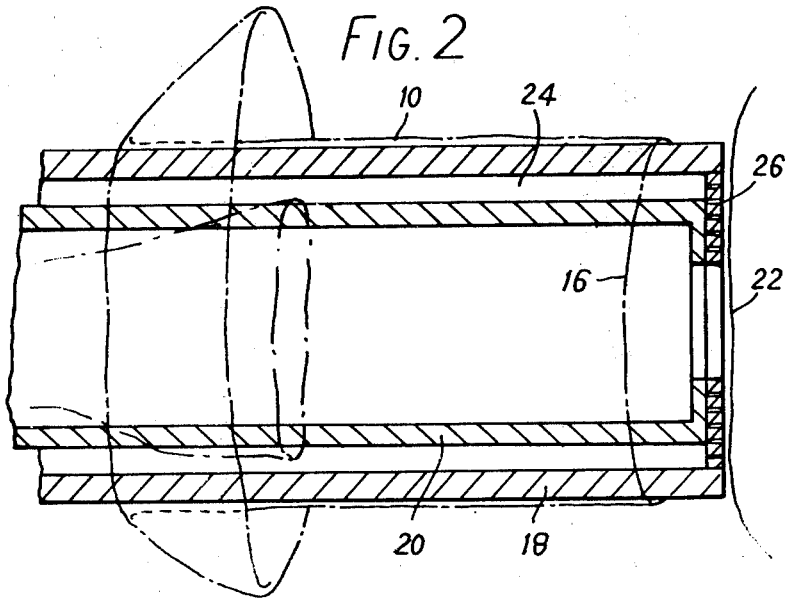

HOSIERY

BACKGROUND OF THE INVENTION

Hitherto the seaming of gussets to panti-hose or similar garments has been effected either by hand using a single seam or by machine using two or more seams.

It has hitherto proved difficult to mechanically seam a gusset to a garment by a single continuous seam and in practice seaming has been effected by two or more machines producing separate portions of the final seam.

SUMMARY AND DESCRIPTION OF THE PRESENT INVENTION

The present invention seeks to provide an improved manner of mechanically seaming gussets in garments.

Accordingly the present invention provides a method of seaming a gusset to a garment comprising supporting the garment and presenting the gusset to the garment with the periphery of the gusset juxtaposed with the garment, and mechanically seaming the garment and the periphery of the gusset together while simultaneously rotating the gusset and the garment relative to a seaming machine and through at least 360° about an axis passing through the gusset to secure the gusset to the garment by a single continuous seam.

The present invention also provides apparatus for seaming a gusset to a garment comprising an elongate support for receiving said garment, means for mounting said gusset, to enable an opening in the garment to be brought into overlapping relationship with the periphery of the gusset; a seaming machine for seaming the gusset and the garment together, said support and mounting means being displaceable relative to said machine to bring the machine into engagement with the garment and gusset, and wherein said support and mounting means are rotatable relative to the seaming machine through an angle of at least 360° and about an axis arranged to pass through the gusset to enable the gusset to be secured to the garment by a single continuous seam.

The present invention is further described hereinafter, by way of example, with reference to the accompanying drawings, in which:

FIG. 1 shows the body portion of a pair of panti-hose;

FIGS. 2 to 5 show various stages in the seaming of a gusset into the panti-hose;

The panti-hose body 10 illustrated in FIG. 1 is seamed at the front and rear at 12 and 14 to leave the crotch 16 open. The panti-hose may be manufactured to this stage either by conventional means or by using the facility available on some automatic line closing panti-hose seaming machines. The crotch 16 is left open to receive a gusset made of any suitable flat fabric which may be knitted, woven or non-woven. The size and shape of the gusset are chosen to suit particular requirements.

FIG. 2 shows the panti-hose body of FIG. 1 turned inside out and pulled over the outer tube of a tube assembly comprising two tubes 18, 20. Tube 20 is located inside tube 18 and is preferably coaxial therewith although the tube axes may be laterally offset relative to one another.

The tubes are axially displaceable relative to one another or in unison and the other tube 18 is conveniently of sufficient length to support the whole of the body 10.

Figure 3:
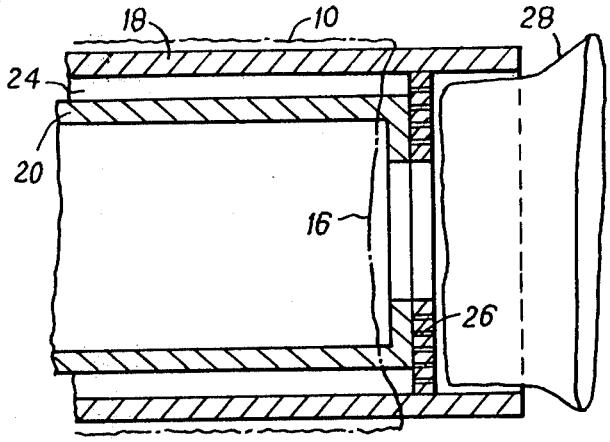

Once the body 10 is mounted on the tube 18 with the front end of the latter projecting through the crotch 16 a gusset 22 is presented to the front end of the tube 18. To hold the gusset in position it is preferred to apply suction to the space 24 between the tubes 18, 20 from a location remote from the front end of the tube 18, and in order to prevent the gusset being drawn into the space 24 a porous screen 26 such as a grill or other suitable lattice work is affixed to the tubes 18, 20 at the ends thereof to bridge the space 24. After the gusset is presented to the front ends of the tubes 18, 20 the inner tube 20 is drawn further into the tube 18, the suction in the space 24 thus drawing the gusset into the tube 18 to form a substantially cupped shape against the inner surface of the tube 18, as shown in FIG. 3.

Figure 4:
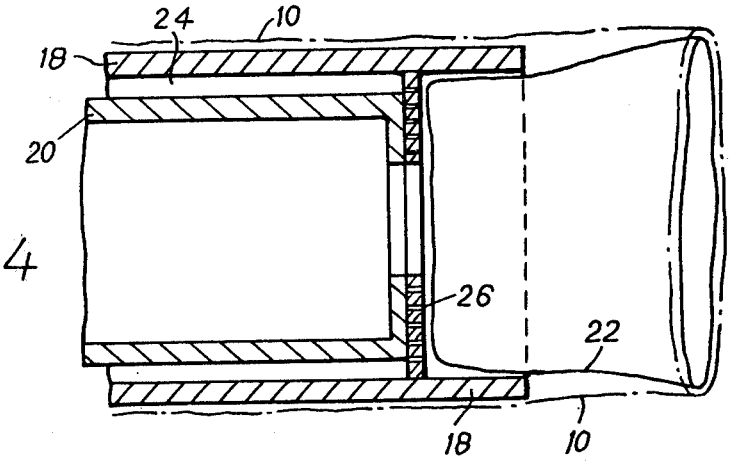

After the gusset 22 has been drawn into the tube 18 a suitable distance to leave a margin 28 outside the tube 18 the body 10 of the panti-hose surrounding the outer tube 18 is moved along the tube 18 from left to right as seen in FIG. 4 until the crotch 16 overhangs the end of the tube 18 and is aligned with the protruding edge of the gusset 22.

The tubes 18, 20 are then moved to bring the overhanging portions of the gusset 22 and body 10 into position between the needle bar assembly 30 and throat or needle plate 32 of a seaming machine such as an overlocking or cup seaming machine. The tube assembly with the body 10 and gusset 22 are rotated about the tube axes through at least 360° while the overlocking machine is running to seam the gusset 22 and body 10 together. The seam produced is at right angles to the seams 12 and 14.

The axis of the overlocking machine camshaft (not shown) is conveniently in the same horizontal plane as the tube axes, and the gusset 22 and body 10 are conveniently held in position and guided by for example suitable guides and air or gas jets.

Figure 5:
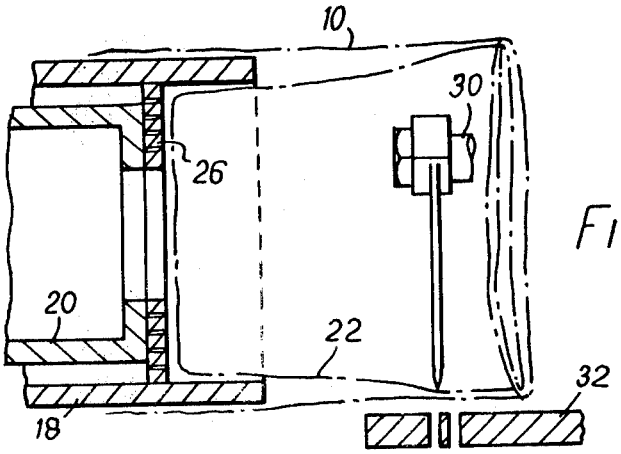

FIG. 5 shows three air jet nozzles 60, 62 and 64.

The nozzle 60 is a suction nozzle located in front of the needle adjacent the sewing path to draw out the edges of the gusset 22 and body 10 into the required sewing position. The nozzle 60 preferably has a flattened mouth conveniently in a fan-tail shape with its side edges slotted to allow the edges of the gusset and body partially to enter the mouth and so ensure a more efficient orientation of the edges for sewing. The nozzle 64 is a pressure nozzle which is located adjacent the needle and directs a jet of air at the gusset and body edges of sufficient force to retain the edges in the required sewing position otherwise once past the suction nozzle 60 the latter could spring back out of the needle path as a result of the natural resilience of the material. A plurality of nozzles 60 and 64 may be provided.

Cutting means such as knives (not shown) are provided to trim the edges prior to sewing and the suction nozzle 62 draws off the trimmed waste.

The shape of the gusset may be chosen to suit any particular requirement provided the cross-sectional shape of at least the tube 18 and preferably both tubes 18, 20 is chosen accordingly. For a circular gusset the tubes would be of circular cross-section and the dimension r (FIG. 5), from the tube 18 axis to the plate 32 would be a radius.

For an eliptical gusset the tube 18 should be eliptical in cross-section and the dimension l would be the variable semi-axis of the elipse. As the semi-axis varies with rotation of the tube assembly the overlocking machine needs to be raised and lowered to compensate for the variation and this can be achieved by suitable means such as one or more cams.

In a modified form (not shown) of the invention the needle bar assembly is located outside the cup-shape of the gusset with the plate 32 inside.

Once seaming of the gusset is complete the suction is transferred to the interior of tube 20 to draw the panti-hose from the tube 18 through the tube 20 and into a suitable collection container.

By varying either or both the rotational speed of the tube assembly and the speed of the overlocking machine the number of stitches per inch of the gusset seam can be varied. The seam may be of single or twin needle form.

While only two tubes 18, 20 have been described the number may be varied and located so as to provide loading, seaming and unloading facilities for the panti-hose in the desired sequence. In addition, while a tube 18 is preferred the latter could comprise a number of paralleled rods or other suitable members arranged in a tube-like formation.

Although the assembly mounting the body 10 is illustrated in a horizontal altitude it may conveniently be orientated at some other altitude, for example vertically. However, additional control of the fabric may then be necessary.

Figure 6:
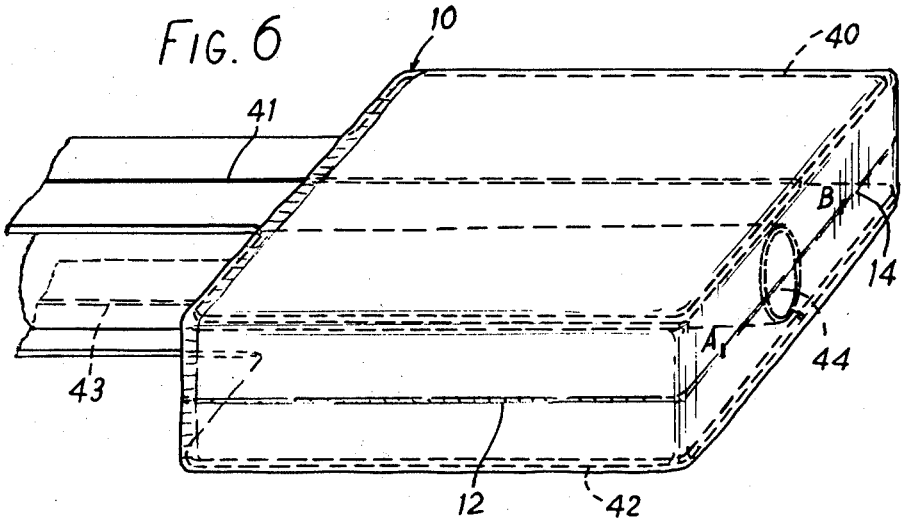
FIG. 6 is a perspective view of a second embodiment according to the present invention.

FIG. 6 shows an alternative assembly to the tube assembly of FIGS. 2 to 5. In FIG. 6 the outer tube 18 is replaced by two paralleled plates 40, 42. Each plate is divided symmetrically into two portions hinged or otherwise pivoted together at 41, 43. A tube 44 between the two plates 40, 42 serves a similar function to tube 20 but in this instance suction is applied through the tube 44. The panti-hose 10 is fitted over the plates 40, 42 as previously described with reference to the tube assembly and the gusset applied in similar fashion. The plates 40, 42 can be hinged about their centre lines 41, 43 to vary the overall shape at their front ends presented to the body 10 thus enabling differently shaped gussets, particularly diamond shaped gussets, to be seamed on the same assembly.

The tube 20, 44 is of course an optional feature, depending upon whether or not suction is required, and where used may comprise a single tube or a plurality of tubes or other suitable means for applying suction.

In addition to or as an alternative to the tube 44 mechanisms for locating the gusset relative to the body may be located outside and/or within the plates. These mechanisms conveniently also stretch and control the body and gusset fabric in such a way as to facilitate seaming.

A gusset may be applied to ready made panti-hose or similar garment in accordance with the present invention in the manner described. Where the seams 12 and 14 have been completed round the crotch 16 the latter is first opened by cutting along the seam between A and B (FIG. 6).

Although suction has been described above as a means of retaining a gusset in position during seaming any suitable means may be used, for example clips or pins.

Figure 7:
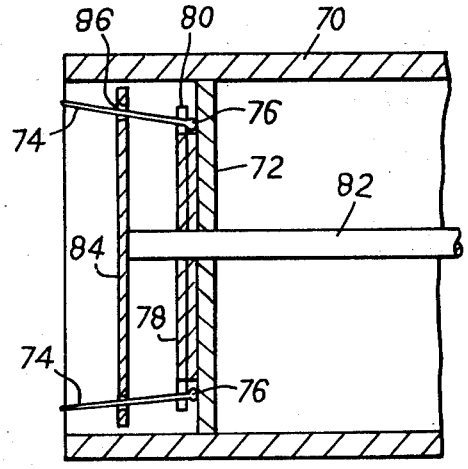
FIG. 7 is a section through a further embodiment according to the present invention.

FIG. 7 is a cross-section through a further form of the invention and comprises a circular cross-section tube 70 similar to the tube 18 and in which is rigidly mounted a circular plate 72. The plate 72 pivotally supports a plurality of needles 74 each of which has a head 76 sandwiched between the plate 72 and a clamping plate 78. The needles 74 are spaced about the perimeter region of the plate 72 and are pivotable radially of the tube axis through slots 80 in the plate 78. Passing through the plates 72, 78 is a rod 82 which is slidable axially of the tube 70 and carries a further plate 84. The latter has holes 86 through which the needles project.

In use, the panti-hose body 10 is stretched over the tube 70 with the front end of the tube projecting through the gusset opening. Where the latter has not been cut the body 10 is stretched over the tube and changed in position and the opening then cut or preferably burned out with suitable means such as a heated wire of the desired shape. The body is then drawn back over the tube 70. A required length of gusset, conveniently cut from a roll of gusset material, is stretched sufficiently to cover the front opening of the tube 70 and is then presented thereto after the plate 84 is driven forward to pivot the needles to their radially innermost position. If necessary, suitable means such as a circular brush is used to tap the gusset onto the needles.

The plate 84 is then retracted to force the tips of the needles 74 against the inner wall of the tube 70 and grip the gusset in position but leaving the gusset edge projecting out of the tube. The panti-hose body is then drawn forward so that the edge of the gusset opening overlaps the gusset edge ready for sewing. Once the gusset has been stitched to the body the plate 84 is moved forward to release the gusset from the needles and the panti-hose is drawn off the tube.

The shapes of the tube 70 and plates 72, 78, 84 can of course be chosen to suit the desired shape of gusset. The needles 74 conveniently carry shoulders or other suitable stops adjacent their tips to prevent the gusset riding down the needles.

While the present invention has been described in relation to panti-hose it will be apparent that it may be applied to any suitable garment requiring the addition of a gusset.

I claim:

1. A method of seaming a gusset to a garment comprising supporting the garment and presenting the gusset to the garment with the periphery of the gusset juxtaposed with the garment, and mechanically continuously seaming the garment and the periphery of the gusset together while simultaneously rotating the gusset and the garment relative to a seaming machine and through at least 360° about an axis passing through the gusset to secure the gusset to the garment by a single continuous seam.

2. A method as claimed in claim 1 wherein the gusset and the garment are mechanically seamed by a seaming machine whose position relative to the axis of rotation is variable radially of said axis and during rotation to enable said machine to follow the gusset periphery.

3. A method as claimed in claim 1 wherein the garment is drawn over an elongate support with an opening in the garment adjacent one end of the support for receiving the gusset, and wherein the gusset is presented to and supported at said one end of the support with the periphery of the gusset overlapping the periphery of said opening.

4. A method as claimed in claim 3 wherein said support comprises an elongated member open at one end and onto which the garment is drawn and an inner member being axially relatively displaceable; and wherein the central portion of a gusset is then displaced into said open end of the member to form the gusset into a substantially cup-shape, and the garment is moved toward said one end to overlap the periphery of said opening with the periphery of the gusset projecting from said outer member.

5. A method as claimed in claim 3 characterised in that said support comprises an elongate member open at one end onto which the garment is drawn and inner support means displaceable relative to said member for gripping said gusset, the garment being moved towards said one end to overlap the periphery of said opening with the periphery of the gripped garment.

6. A method as claimed in claim 4 wherein said garment is moved towards said one end of the support either simultaneously with or subsequent to the displacement of the gusset partially into said member.

7. A method as claimed in claim 6 wherein the garment and the gusset are rotated by rotating said support about its longitudinal axis of said member.

8. A method as claimed in claim 1 wherein said gusset is substantially circular.

9. A method as claimed in claim 1 wherein said gusset is substantially eliptical.

10. A method as claimed in claim 1 wherein the gusset periphery and the garment are maintained in a desired attitude for seaming thereof by the application of suction and air jets.

11. A garment having a gusset seamed thereto according to the method as claimed in claim 1.

12. Apparatus for seaming a gusset to a garment comprising an elongate support for receiving said garment, means for mounting said gusset to enable an opening in the garment to be brought into overlapping relationship with the periphery of the gusset; a seaming machine for seaming the gusset and the garment together, said support and mounting means being displaceable relative to said machine to bring the machine into engagement with the garment and gusset, and wherein said support and mounting means are rotatable relative to the seaming machine through an angle of at least 360° and about an axis arranged to pass through the gusset to enable the gusset to be secured to the garment by a single continuous seam.

13. Apparatus as claimed in claim 12 wherein the support comprises a substantially tubular member over which the garment is arranged to be drawn with said opening adjacent an open end of the member, and the support and mounting means are relatively displaceable to move the gusset partially into said open end to overlap the periphery of said opening with the periphery of the gusset.

14. Apparatus as claimed in claim 13 wherein said mounting means in a second elongate member located within said tubular member.

15. Apparatus as claimed in claim 14 further comprising means for applying suction to the space between said members for holding the gusset against said one end.

16. Apparatus as claimed in claim 15 wherein said space is bridged by a porous screen for preventing suction of the gusset into said space.

17. Apparatus as claimed in claim 14 wherein said second member is substantially tubular and coaxial with said first member.

18. Apparatus as claimed in claim 12 wherein the support means comprises a substantially tubular member over which the garment is arranged to be drawn with said opening adjacent an open end of the member, and said mounting means is displaceable relative to the support to grip the gusset.

19. Apparatus as claimed in claim 18 wherein said mounting means comprises a plurality of needles displaceable to grip the gusset between said needles and said support.

20. Apparatus as claimed in claim 12 wherein the support comprises a pair of substantially parallel plates.

21. Apparatus as claimed in claim 20 wherein each plate is hinged about a centre line to enable said plates to adopt various configurations in dependence on the shape of the gusset to be seamed.

* * * * *